United States Patent [19]

Stumpp

[11] Patent Number: 4,487,182

[45] Date of Patent: Dec. 11, 1984

[54] CONTROL DEVICE FOR INTERNAL COMBUSTION ENGINES

[75] Inventor: Gerhard Stumpp, Stuttgart, Fed. Rep. of Germany

[73] Assignee: Robert Bosch GmbH, Stuttgart, Fed. Rep. of Germany

[21] Appl. No.: 460,700

[22] Filed: Jan. 24, 1983

[30] Foreign Application Priority Data

Apr. 28, 1982 [DE] Fed. Rep. of Germany ..... 3215736

[51] Int. Cl.[3] ..... F02D 1/14

[52] U.S. Cl. ..... 123/383; 123/380; 123/503

[58] Field of Search ..... 123/383, 382, 391, 380, 123/385–388, 389, 503

[56] References Cited

U.S. PATENT DOCUMENTS 2045349 10/1980 GBX .

3,736,912 6/1973 Okura et al. ..... 123/380

4,058,101 11/1977 Taira et al. ..... 123/382

4,228,774 10/1980 Ritter et al. ..... 123/383

4,308,834 1/1982 Ehgim ..... 123/383

4,359,986 11/1982 Kramer ..... 123/383

FOREIGN PATENT DOCUMENTS 2045349 10/1980 United Kingdom .

*Primary Examiner*—Magdalen Y. C. Moy

*Attorney, Agent, or Firm*—Edwin E. Greigg

[57] ABSTRACT

A control device for internal combustion engines, especially for turbocharged diesel engines. The control device is arranged to generate a control distance proportional to the amount of air supplied to the engine. The control device includes a pressure chamber charged by the intake air pressure, which is separated from the back-pressure chamber by a membrane. A stop abuts against the membrane and is scanned via an intermediate lever by a supply volume adjustment element of a fuel pump. The reference absolute pressure in the back-pressure chamber is positioned between a throttle with variable throttle diameter and a throttle with fixed throttle diameter. A vacuum pump aspirates air via the throttle with fixed throttle diameter, connected to atmospheric pressure, and the throttle with variable throttle diameter is arranged to respond to the reference absolute pressure.

4 Claims, 2 Drawing Figures

CONTROL DEVICE FOR INTERNAL COMBUSTION ENGINES

BACKGROUND OF THE INVENTION

The present invention is based on a control device for internal combustion engines. A control device is already known in which a constant reference absolute pressure is regulated by an absolute pressure regulator and stresses a movable wall; the wall either limits the placement of a load-pressure-dependent full-load stop for the full-load position, permissible in each case, of the supply volume adjustment element of the fuel metering device, or else acts on a regulator linkage in order to adjust the regulator characteristic to the changing manifold pressure.

OBJECT AND SUMMARY OF THE INVENTION

The control device in accordance with the present invention, has the advantage that a regulation of the reference absolute pressure becomes possible by simple means.

Further advantageous developments and improvements of the control device are revealed in this application and finally claimed hereinafter.

The invention will be better understood and further objects and advantages thereof will become more apparent from the ensuing detailed description of preferred embodiments taken in conjunction with the drawings.

BRIEF DESCRIPTION OF THE DRAWINGS

Two exemplary embodiments of the present invention are shown in simplified form in the drawings and are further explained in the following description.

DESCRIPTION OF THE PREFERRED EMBODIMENTS

Figure 1:
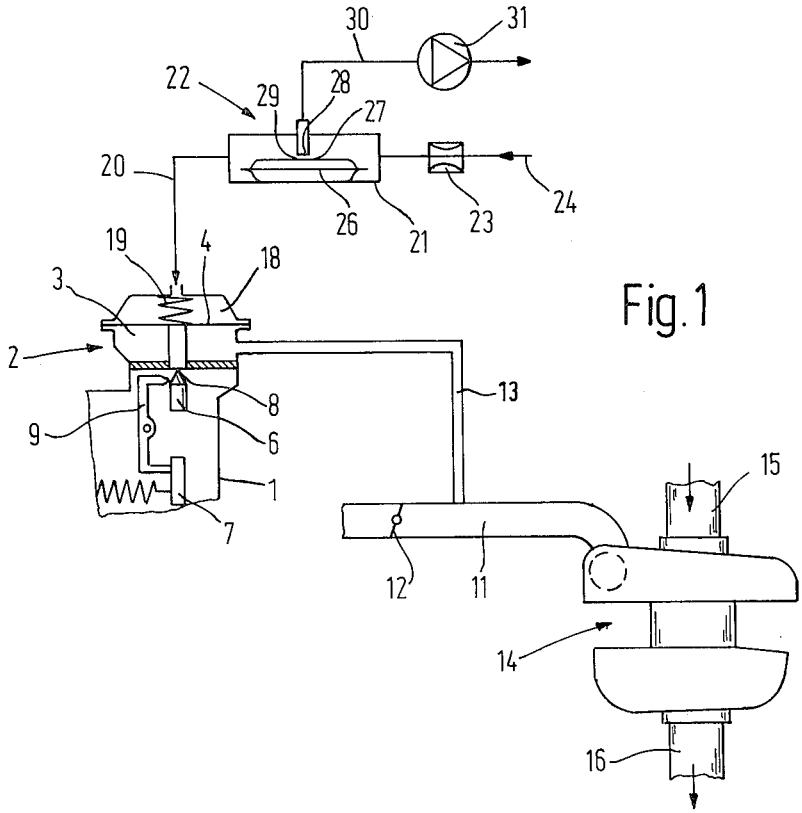
FIG. 1 shows a schematic first exemplary embodiment of the control device in accordance with the present invention.

In the schematic exemplary embodiment shown in FIG. 1, a control device 2 is flanged to a pump housing 1 of an only partially shown fuel pump for a Diesel engine which serves as a fuel metering device. The control device 2 has a pressure chamber 3, closed on one side by a movable wall, such as the membrane 4. The membrane 4 acts on an adjustable stop 6 of a supply volume adjustment element 7 of the fuel injection pump. The adjustable stop 6 has a contour 8, which is scanned by an intermediate lever 9, on the other side of which the supply volume adjustment element 7 abuts. The intermediate lever 9, formed as a dual-arm lever, changes its position in accordance with the axial displacement of the stop 6 and functions as a load limiting stop, for instance as a full-load stop limiting the maximum amount of injected fuel which is supplied by the fuel injection pump. A charge air line 13 which leads to an intake tube 11 upstream from a throttle valve 12, is connected with the pressure chamber 3. A turbo supercharger 14 aspirates atmospheric air via an intake nozzle 15 and blows it into the intake tube 11, so that the manifold pressure produced by the turbo supercharger 14 by the connection via the charge air line 13 prevails in the pressure chamber 3 of the control device 2. The turbo supercharger 14 is driven by the exhaust gas which flows from the internal combustion engine through the exhaust pipe 16.

The membrane 4 of the control device 2 separates the pressure chamber 3 from a back-pressure chamber 18, in which a pressure spring 19 which stresses the membrane 4, is disposed and into which leads a reference-pressure line 20. The reference-pressure line 20 leads into a work chamber 21 of a throttle 22 provided with a variable throttle diameter, upstream of which is disposed a throttle 23 with a fixed throttle diameter, and on the other side of which outside air 24 is present. An evacuated hollow body 26, for instance an aneroid box, is contained in the work chamber 21 and provided with a work surface 27 which acts in conjunction with a valve seat 28 which extends into the work chamber 21, thereby opening a variable throttle diameter to a larger or lesser degree, so that more or less air can flow from the work chamber 21 via the valve seat 28 into a vacuum line 30. The vacuum in the vacuum line 30 is created by the vacuum pump 31 which serves as a vacuum source. The constant reference absolute pressure in the back-pressure chamber 18 therefore is created through the aspiration of air by the vacuum pump 31 via the throttle 23 with fixed throttle diameter and the throttle 22 with variable throttle diameter, whereby the variable throttle diameter 29 of the throttle 22 is dependent on the prevailing reference absolute pressure. The choice of the strength of the pressure spring 19 and the reference absolute pressure insure that the amount of fuel injected by the fuel injection pump is limited by the amount of air available to the engine.

Figure 2:
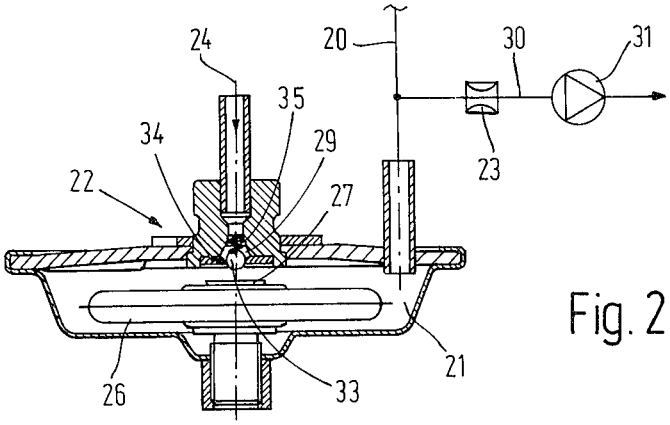
FIG. 2 shows generally in cross-section a second exemplary embodiment of the control device in accordance with the present invention.

In the only partially shown second exemplary embodiment of a control device of FIG. 2, those parts which perform the same function or operate in the same manner as in the first exemplary embodiment of FIG. 1 are assigned the same reference numerals. In the second exemplary embodiment in accordance with FIG. 2 the vacuum pump 31 aspirates air via the throttle 22 with variable throttle diameter 29, connected to atmospheric pressure 24 on one side, and the throttle 23 with fixed throttle diameter. The reference pressure line 20 which leads to the back-pressure chamber 18, branches off between the two throttles 22 and 23. While in the first exemplary embodiment according to FIG. 1 the work surface 27 of the aneroid box 26 moves farther away from the valve seat 28 with increasing reference absolute pressure in the work chamber 21 and thereby increases the variable throttle diameter 29. On the other hand in the second embodiment according to FIG. 2 the work surface 27 of the aneroid box 26 works in such a way, that it rises toward a movable valve part 33, which can be embodied as a ball, with the reaching of the reference absolute pressure, and that the movable valve part 33 contacts a valve seat 34 and interrupts the connection between the atmospheric air 24 and work chamber 21. If the absolute pressure in the work chamber 21 falls, the work surface 27 of the aneroid box 26 moves the movable valve part 33 against the force of a return spring 35, so that the movable valve part 33 moves away from the valve seat 34 and opens a variable throttle diameter 29, by way of which the throttled atmospheric air can flow into the work chamber 21.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A control device for supercharged diesel internal combustion engines, said control device comprising a wall movable against a force of a return means by an intake air of said engine and thereby arranged to influence a full-load position of a supply volume adjustment element of a fuel metering device, said movable wall further arranged to separate a pressure chamber connected by a line to an intake tube of said engine from a back-pressure chamber, said back-pressure chamber being connected to a reference absolute pressure which is constant under all working conditions of said device, characterized in that said reference absolute pressure is generated in a line by a vacuum source which aspirates atmospheric air via at least two throttle means, at least one of said throttle means having a fixed throttle diameter and at least another of said throttle means having a variable throttle diameter which is controlled by a movable wall of an evacuated chamber, said movable wall being exposed to a resulting pressure of said reference absolute pressure in the line between said two throttle means.

2. A control device in accordance with claim 1, characterized in that said throttle means provided with said variable throttle diameter is disposed downstream from said other throttle means with fixed throttle diameter, upstream of which an atmospheric pressure exists.

3. A control device in accordance with claim 1, characterized in that said throttle means provided with said variable throttle diameter is disposed upstream from said throttle means provided with said fixed throttle diameter and downstream of which said vacuum source is disposed.

4. A control device in accordance with claim 3, characterized in that said throttle means provided with said variable throttle diameter further includes a work chamber, connected with said reference absolute pressure, in which is disposed said evacuating means, said evacuating means further including a work surface which is arranged to cooperate with a movable valve element, said work surface further adapted to move said valve element away from a fixed valve seat and an atmospheric pressure in existence upstream of said valve seat.

* * * * *